US006132121A

United States Patent [19]

Brings et al.

[11] Patent Number: 6,132,121

[45] Date of Patent: Oct. 17, 2000

[54] DOCUMENT-PRINTING ARRANGEMENT WITH DOCUMENT-COLLECTION STATION

[75] Inventors: Bernhard Brings; Richard Düsterhus; Bernd Reimer; Pamela Szlezys, all of Paderborn, Germany

[73] Assignee: Siemens Nixdorf Informationssysteme Aktiengesellschaft, Paderborn, Germany

[21] Appl. No.: 09/269,986

[22] PCT Filed: Nov. 20, 1997

[86] PCT No.: PCT/DE97/02724

§ 371 Date: Apr. 5, 1999

§ 102(e) Date: Apr. 5, 1999

[87] PCT Pub. No.: WO98/28137

PCT Pub. Date: Jul. 2, 1998

[30] Foreign Application Priority Data

Dec. 20, 1996 [DE] Germany ..... 196 53 487

[51] Int. Cl.[7] ..... B41J 11/70

[52] U.S. Cl. ..... 400/621; 101/227; 101/409

[58] Field of Search ..... 101/226, 227, 101/246, 408, 409, 485, 232, 228; 400/621, 708; 271/245, 246, 247, 265.01, 227, 228

[56] References Cited

U.S. PATENT DOCUMENTS

| | | | |
|---|---|---|---|
| 4,132,403 | 1/1979 | Weisbach et al. . | |
| 4,594,597 | 6/1986 | Lin et al. . | |
| 4,766,463 | 8/1988 | Watanuki et al. | 355/14 SH |
| 5,390,908 | 2/1995 | Luxem | 271/247 |
| 5,606,913 | 3/1997 | Kowalewski | 101/183 |
| 5,699,741 | 12/1997 | Schmidt et al. | 101/485 |
| 5,768,675 | 6/1998 | Estabrooks | 399/385 |

FOREIGN PATENT DOCUMENTS

| | | |
|---|---|---|
| 42 25 418 A1 | 2/1994 | Germany . |
| 2 054 534 | 2/1981 | United Kingdom . |
| WO 94/21465 | 9/1994 | WIPO . |
| WO 94/22117 | 9/1994 | WIPO . |

*Primary Examiner*—Ren Yan
*Attorney, Agent, or Firm*—Hill & Simpson

[57] ABSTRACT

Document-printing arrangement (8) having a cutting arrangement (16) and a document collection station (22), which is designed as a drum (40) equipped with clamping elements (44). Starting from a rest position (−x°), the drum (40) is accelerated in such a way that when the leading edge of a document arrives underneath the clamping elements (44), said drum has a circumferential speed which corresponds to the transport speed of a paper transport arrangement (12).

5 Claims, 1 Drawing Sheet

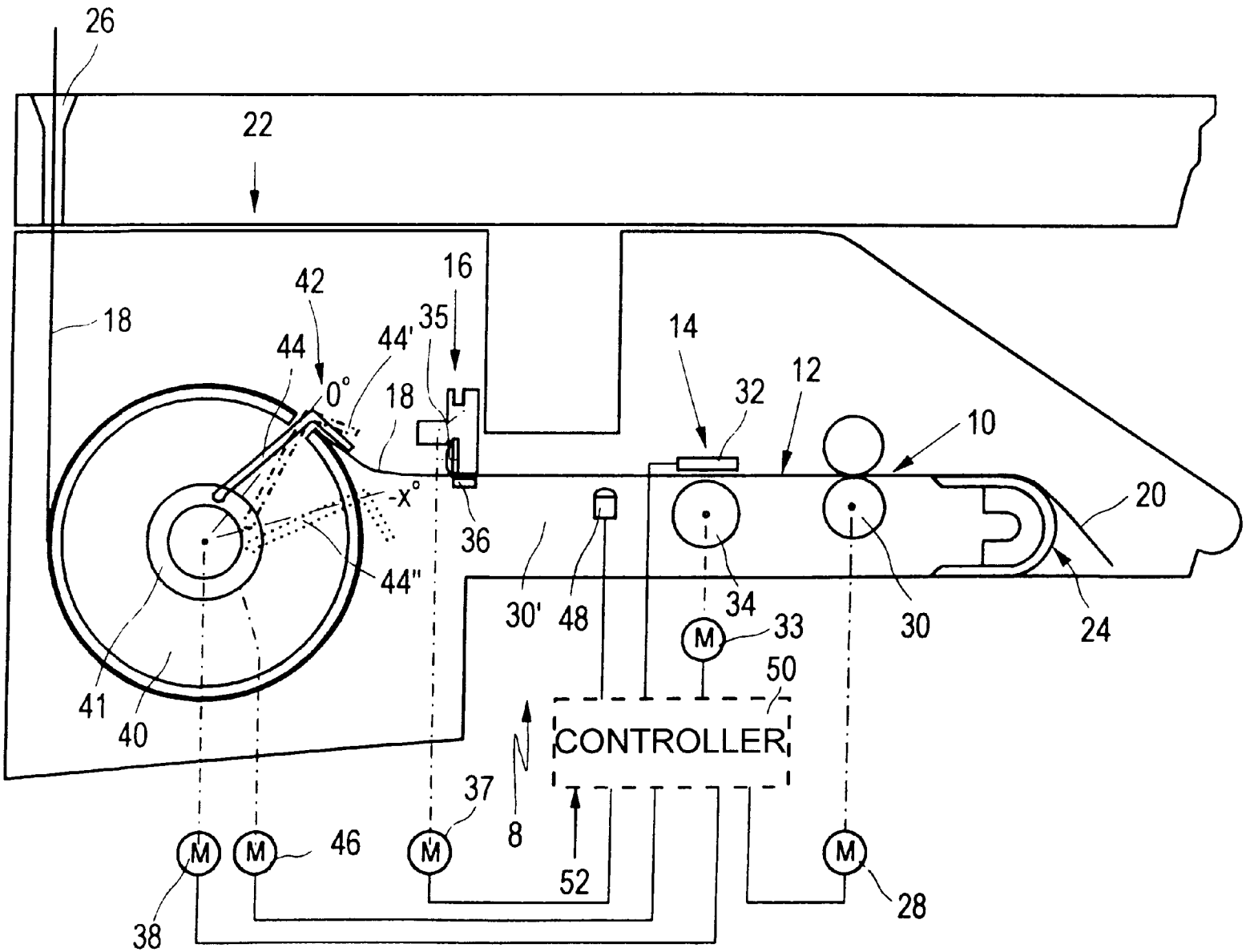
CONTROLLER
10
12
14
16
18
20
22
24
26
28
30
30'
32
33
34
35
36
37
38
40
41
42
44
44'
44"
46
48
50
52
8
0°
-x°

DOCUMENT-PRINTING ARRANGEMENT WITH DOCUMENT-COLLECTION STATION

BACKGROUND OF THE INVENTION

Technical Field

The invention relates to a document-printing arrangement.

Prior Art

A prior art document-printing arrangement is disclosed in the international patent application WO 94/22117 A1. In this document, use is made of a document collection station which is designed as a drum, as is described in German Offenlegungsschrift DE 42 25 418 A1. The drum is only set rotating when a document has been transported under the clamping elements by the paper transport arrangement. In this case, the document is pushed against the operating levers of the clamping elements, which levers project from the interior of the drum, which is still at rest, and is compressed, which leads to buckling of the document between the printing station and the drum. Since the cutting arrangement is also arranged in the buckling area, the buckling of the document leads to an unacceptably high tolerance on the cut length.

SUMMARY OF THE INVENTION

The object of the present invention is a document-printing arrangement of the above-mentioned type in which buckling of the document is avoided.

The invention is based on the consideration that buckling of the document is avoided if, at the moment at which the leading edge of the continuous paper web arrives tangentially on the outer surface of the drum, the circumferential speed of the drum corresponds to the advance speed of the continuous paper web, that is to say the operating levers of the clamping elements lead the forwardly transported paper edge by a short distance.

To this end, a light barrier that responds to the leading edge of the continuous paper web is arranged in the paper path and, in its rest position, the drum assumes a second angular position which—as viewed in the direction of rotation of the drum—is set back by a prescribable angular dimension with respect to a first angular position. Starting from the second angular position, when the leading edge of the continuous paper web is reported by the light barrier, the drum is accelerated in such a way that, at the moment at which the leading edge of the continuous paper web runs into the transfer position, said drum has reached the first angular position and the circumferential speed of the drum corresponds to the transport speed of the continuous paper web. This achieves the situation in which the leading edge of the continuous paper web no longer collides with the operating levers of the clamping elements. Compression of the paper edge and buckling in the document are therefore prevented. It is therefore possible for even particularly brittle papers or those having a low inherent stiffness to be processed.

A further advantage of the document-printing arrangement according to the invention is to be seen in the fact that it is also possible to use printing processes having a high paper advance speed, and those having a continuous paper advance. In a development of the invention, use is made of this advantage by the printing station having a thermal printing bar.

Displacing the clamping elements between their releasing position and their clamping position during the rotation of the drum can be implemented in a particularly simple way by the displacement being carried out by means of an electric motor provided specifically for this.

In an advantageous development of the invention, the electric motors are designed as stepping motors. The paper advance speed is known from the stepping pulse sequence of the electric motor which drives the impression roll. It is therefore simply possible to apply stepping pulses to the electric motor of the drum, these pulses defining an acceleration ramp which is matched to the circumferential speed of the impression roll—conveying the continuous paper web through the printing station—the electric motor of the drum being started at the point where the leading edge of the continuous paper web is detected by the light barrier. Starting from the leading edge of the continuous paper web, the current length of a document can be determined at the same time from the number of stepping pulses of the electric motor which drives the impression roll and, when a prescribed desired document length is reached, the electric motors of the paper transport arrangement, of the impression roll and of the drum are stopped and the cutting arrangement is operated.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawing, in which:

The single FIGURE shows a schematic sectional illustration of a document-printing arrangement with document collection station.

DESCRIPTION OF THE PREFERRED EMBODIMENTS

A document-printing arrangement 8, illustrated schematically in the FIGURE, contains a paper path 10, on which there are arranged a paper transport arrangement 12, a printing station 14, a cutting arrangement 16 for cutting individual documents 18 from a continuous paper web 20 and a document collection station 22 for documents 18 that have been cut off. The continuous paper web 20 may be rolled up on a roll or Z-folded. It may be plain or provided with preprinted forms, the latter only being filled out in the printing station 14.

The paper path 10 extends from an entry area 24 for the entry of the continuous paper web 20 as far as an output slot 26 for the output of ready-printed documents 18. The paper transport arrangement 12 follows the entry area 24. Said paper transport arrangement essentially comprises a pair of drive rollers 30 which are driven by a first stepping motor 28 and which are arranged upstream of the printing station 14. The latter comprises a thermal printing bar 32 arranged above the paper path, and an impression roll 34 which is arranged opposite said thermal printing bar, underneath the paper path 10, and is driven by a second stepping motor 33. Inserted into the paper path 10 downstream of the printing station 14 is a light barrier 48, which responds to the leading edge of the continuous paper web 20.

Located in the paper path 10, downstream of the light barrier 48, is the cutting arrangement 16, having a knife which is designed as a cutting roller 35, which interacts with a cutting rail 36. The cutting roller 35 can be displaced over the entire width of the continuous paper web 20, at right-angles to the transport direction thereof, by a third stepping motor 37. The cutting arrangement 16 serves to cut the documents 18 from the continuous paper web 20 and thus to separate them.

Adjoining the cutting arrangement 16 is the document collection station 22, whose basic construction and function are described in DE 42 25 418 A1 and are therefore explained here only to the extent which is needed for the understanding of the present invention. The document collection station 22 contains a drum 40, which can be driven in both directions of rotation by a fourth stepping motor 38 and which transports the individual documents 18 into a pair of tongs 42. The latter are formed by clamping elements 44, which are arranged on the outer side of the drum 40, and which can be displaced between a clamping position (illustrated by continuous lines) in which they rest on the outer surface of said drum, and a raised releasing position (illustrated dash-dotted), independently of the rotary drive of the drum 40. However, while in the arrangement according to DE 42 25 418 A1 the displacement of the clamping elements and the drive to the drum are provided by a single drive, to which these elements may optionally be coupled, the clamping elements 44 here are operated by a separate drive, a fifth stepping motor 46. The latter is able to rotate an actuating ring 41, which pivots the clamping elements and is arranged concentrically with the drum 40, in both directions of rotation relative to the drum 40. The tongs 42 are opened if the actuating ring 41 is rotated in the clockwise direction and are closed in the event of a rotation in the counterclockwise direction. This makes it possible to displace the clamping elements 44 during the rotation of the drum 40.

The five stepping motors 28, 33, 37, 38 and 46, the thermal printing bar 32 and the light barrier 48 are connected to a control arrangement 50, to which the printing tasks are fed from outside the document-printing arrangement 8 via a data line 52. Said control device controls the document-printing arrangement 8 in the manner which is described below for a document-processing operation, it being assumed that the drum 40 is in a rotational angle position −x°. In this position, the clamping elements, which are raised from the outer surface of the drum 40, are located in a position 44", illustrated dotted, underneath the line of contact between the continuous paper web 20 and the drum 40.

The document-processing operation begins with the continuous paper web 20 being transported along the paper path 10 until the light barrier 48 reports the leading edge of the continuous paper web 20. The thermal printing bar 32 is thus at a defined distance from the leading edge. The stepping pulses of the second stepping motor 33 are counted at the same time from then on, so that the printing of a document may be carried out on the correct lines. Since the printing operation using the thermal printing bar is associated with a continuous paper advance, the time which elapses until the leading edge of the continuous paper web 20 arrives on the drum 40 is known, and thus the number of stepping pulses which still have to be fed to the second stepping motor 33 is also known. When a step is reached which is prescribed by the geometry of the document-printing arrangement 8 and the circumferential speed of the impression roll 34, the fourth stepping motor 38 has applied to it a stepping pulse sequence which corresponds to a defined acceleration ramp of the drum 40 up to a circumferential speed which corresponds to the advance speed of the continuous paper web 20. The stepping pulse sequence is selected such that the drum 40 has just reached its rotational angle position 0° at the moment at which the leading edge of the continuous paper web 20 arrives, and is rotating at a circumferential speed which corresponds to the advance speed of the continuous paper web 20. In this position, the clamping elements are raised from the outer surface of the drum and are located in the position 44', which is illustrated dash-dotted. As soon as the drum 40 has moved past the rotational angle position 0°, the fifth stepping motor 46 is energized in such a way that the actuating ring 41 is rotated in the counter-clockwise direction relative to the drum 40, as a result of which the tongs 42 close during the rotation of the drum.

The document transport arrangement 12, the impression roll 34 and the drum 40 continue to be operated in the forward transport direction of the continuous paper web 20 until the desired length of the document 18 has been reached. The first, second and fourth stepping motors 28, 33, 38 then have stepping pulses of a defined braking ramp applied to them, this ramp being dimensioned such that the continuous paper web 20 is always tautly tensioned between the impression roll 34 and the drum 40. When the three stepping motors 28, 33, 38 stop, the lower edge of the document 18 is located on the cutting line of the cutting arrangement 16, which is now operated by supplying an appropriate pulse train to the third stepping motor 37. After this, the first stepping motor 28 and the second stepping motor 33 are operated in the direction opposite to the drawing-in direction of the paper transport arrangement 12, as a result of which the continuous paper web 20 is conveyed back until its leading edge clears the light barrier 48 again. The fourth stepping motor 38 rotates the drum 40 in the counterclockwise direction until the rotational angle position −x° has been reached again.

For each document 18 to be accommodated, the drum 40 completes one revolution in the counter-clockwise direction. Once a specific number of documents 18 from a running printing task have been deposited in the tongs 42, the direction of rotation of the drum 40 is reversed, and the bundle of documents is provided in the output slot 26 for removal. For this purpose, the tongs 42 are opened.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A document-printing arrangement comprising a paper path having at least a paper transport means for transporting a continuous paper web, said transport means being driven by a first electrical motor, a printing station having a second electrical motor being positioned along the paper path downstream of the transport means, a light barrier responding to a leading edge of the continuous paper web being arranged in the paper path downstream of the printing station, a cutting arrangement for cutting individual documents from the continuous web being arranged downstream from the light barrier and including a third electrical motor and a document collection station for the documents which have been cut off, said document collection station comprising a drum being rotated by a fourth electrical motor and having an outer surface having clamping elements which are displaceable between a clamping position, resting on the outer surface and a raised, released position independent of the fourth electrical motor of the drum, a document being able to run under the raised clamped elements at a transfer position at a specific first angular position of the drum relative to the paper path, said drum having a rest position being at a second angular position which, as viewed in the direction of rotation of the drum, is set back by a prescribable angular dimension with respect to the first angular position when the leading edge of the continuous web is detected, so that when the leading edge of the continuous paper web is detected, said drum is accelerated so that at a moment when the leading edge of the continuous web runs into the transfer position, the drum has reached the first angular position and a circumferential speed of the drum corresponds to the transport speed of the paper transport means.

2. A document-printing arrangement according to claim 1, wherein the printing station comprises an impression roll rotatable by said second electrical motor and a thermal printing bar positioned opposite the impression roll.

3. A document-printing arrangement according to claim 1, which includes a fifth electrical motor for displacing the clamping elements between the released position and the clamping position during rotation of said drum.

4. A document-printing arrangement according to claim 1, wherein the cutting arrangement includes a cutting roller being movable transverse to the paper path by the third electrical motor.

5. A document-printing arrangement according to claim 1, wherein the first, second and fourth electrical motors are each stepping motors, wherein, when the leading edge of the continuous paper web is detected by the light barrier, the fourth electrical motor has applied thereto stepping pulses which define a prescribed acceleration ramp and substantially simultaneously the length of the document is determined, starting from the leading edge of the continuous paper web, from the number of stepping pulses of the second electrical motor and wherein, when a prescribed desired document length is reached, the first, second and fourth electrical motors are stopped and the cutting arrangement is operated.

* * * * *